United States Patent [19]

Munroe

[11] Patent Number: 4,499,398

[45] Date of Patent: Feb. 12, 1985

[54] INCANDESCENT LIGHTING

[76] Inventor: Ronald G. Munroe, 600 Hylan Blvd., Staten Island, N.Y. 10305

[21] Appl. No.: 386,345

[22] Filed: Jun. 8, 1982

[51] Int. Cl.[3] ..... H01K 1/24; H01K 1/64; H01K 1/18

[52] U.S. Cl. ..... 313/113; 313/578; 313/271; 313/274; 313/275; 313/276; 313/315; 315/64; 315/69; 315/73

[58] Field of Search ..... 313/315, 271, 274, 275, 313/284, 285, 286, 289, 578, 113, 276; 315/73, 64, 67, 69, 313, 362

[56] References Cited

U.S. PATENT DOCUMENTS

| | | | |
|---|---|---|---|
| 1,733,504 | 10/1929 | MacDonald | 313/276 |
| 3,028,523 | 4/1962 | Seid | 315/64 |
| 3,080,497 | 3/1963 | Noel et al. | 313/315 |
| 3,211,938 | 10/1965 | Holcomb | 313/113 |
| 3,638,068 | 1/1972 | Wilson | 315/73 |

FOREIGN PATENT DOCUMENTS

| | | | |
|---|---|---|---|
| 534088 | 2/1941 | United Kingdom | 315/67 |

*Primary Examiner*—Leo H. Boudreau
*Assistant Examiner*—K. Wieder
*Attorney, Agent, or Firm*—Kirschstein, Kirschstein, Ottinger & Israel

[57] ABSTRACT

An improved incandescent light bulb which is capable of affording increased light efficiency without a resultant increase in either cost or energy consumption. In one embodiment of the bulb, said bulb includes a refractory stiff supporting element, at least one elongated helical resistive filament, two terminals which are each capable of being physically and electrically connected to a different socket and an elongated light transmissive envelope. In another embodiment the bulb additionally includes a reflector bonded to the envelope which reflects light and conducts heat away from said envelope. The stiff supporting element is formed to have a hollow interior. In said hollow interior a magnetizable elongated slug and two holding magnets may be contained. The slug and holding magnets cooperate with a switching means in the interior of the envelope to allow the bulb to selectively emit either a bright or a dim light.

19 Claims, 10 Drawing Figures

FIG. 2
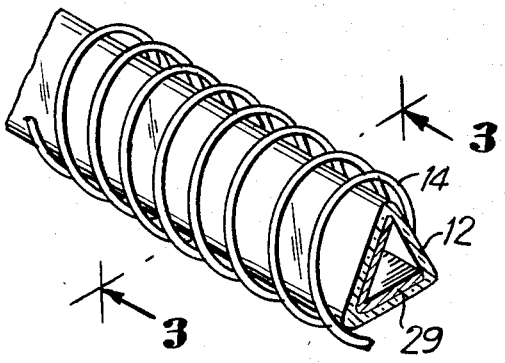
FIG. 3
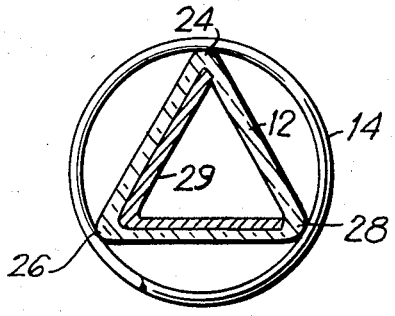
FIG. 4
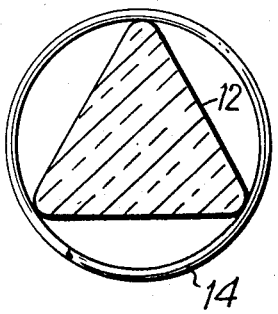
FIG. 5
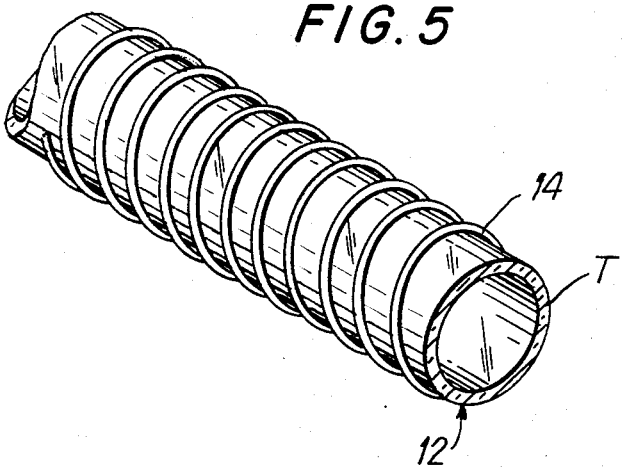
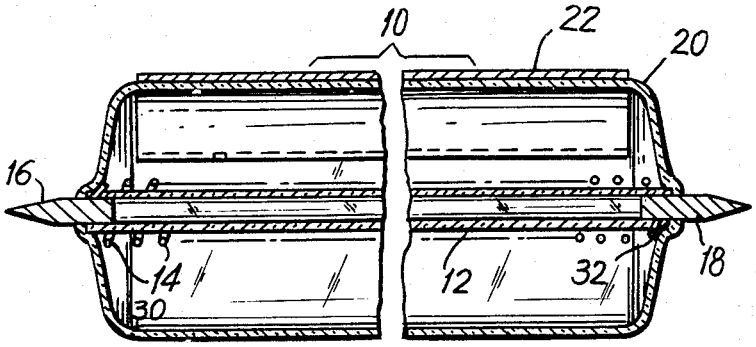
FIG. 1

INCANDESCENT LIGHTING

BACKGROUND OF THE INVENTION

1. Field of the Invention

This invention relates to an improved low-cost, low-energy-consuming incandescent tubular lamp which provides increased light efficiency.

2. Description of the Prior Art

An incandescent tubular lamp which is low-cost, low-energy-consuming and which provides increased light efficiency is particularly desirable now, when there exists a good deal of public concern about conservation of energy.

Incandescent tubular lamps of a variety of types are well known in the art.

U.S. Pat. No. 2,931,933 discloses an incandescent lamp with an interior reflective coating for reflecting the light emitted from the incandescent filament.

U.S. Pat. Nos. 3,012,167 and 3,080,497 disclose tubular incandescent lamps with pin terminals.

U.S. Pat. No. 3,073,986 discloses a tubular lamp with a double coil incandescent filament supported by spaced metal discs.

U.S. Pat. No. 3,891,885 discloses an incandescent lamp in which a coil filament is supported in an envelope by support wires.

None of the above patents utilizes the modifications in structure of the lamp for the purpose of obtaining a low-cost, low-energy-consuming, high-efficiency incandescent tubular lamp.

Other relevant patents are U.S. Pat. Nos. 2,068,423; 2,964,668; 3,040,204; 3,091,718; 3,930,178; 3,943,395; 3,953,757; 3,982,145; and 4,179,639.

SUMMARY OF THE INVENTION

1. Objects of the Invention

It is an object of the invention to provide an incandescent tubular lamp which avoids the problems of prior art tubular incandescent light bulbs.

Another object of the invention is to provide a low-cost, low-energy-consuming incandescent tubular lamp which has an increased light efficiency.

Yet a further object of this invention is to provide an incandescent tubular lamp which is relatively simple to manufacture.

A further object of this invention is to provide an incandescent tubular lamp that can be assembled automatically.

It is yet another object of the invention to provide an incandescent tubular lamp which minimizes the hazard of electrical shock while changing the lamp.

Another object of the invention is to provide an incandescent tubular lamp which is capable of directing the light emitted therefrom where needed.

Still another object of this invention is to provide an incandescent tubular lamp in which the lamp envelope is kept relatively cool.

Another object is to provide an incandescent tubular lamp which is capable of selecively emitting either a dim or a bright light without the use of an external dimmer switch.

Another object is to provide an incandescent tubular lamp in which the massive screw base of a common incandescent lamp is eliminated, thereby doing away with the large non-luminous heat transfer associated with the use of such a base.

Other objects of this invention in part will be obvious and in part will be pointed out hereinafter.

2. Brief Description of the Invention

In keeping with the foregoing objects and others which will become apparent hereinafter, one feature of the invention resides, briefly stated, in an improved incandescent tubular lamp usable with a pair of sockets, and containing an elongated refractory stiff element which internally supports at least one elongated helical heavy resistive filament. The filament generates light when heated to incandescence and has a different terminal proximate each of its ends. The element and filament are contained within a light-transmissive tubular envelope which is connected to the terminals physically by means which are mutually coaxial with one another and with the envelope, and which extend away therefrom.

The stiff element allows the use of a heavier-than-normal filament which, in turn, causes more light to be emitted from the lamp. In a preferred embodiment, the stiff filament-supporting element includes means for reflecting the light generated by the lamp which results in increased light efficiency.

Another feature of this invention resides in making the terminals of the lamp outwardly tapered. The tapered terminals permit the envelope to be rotated so as to direct the light where needed and further trap heat in the filament and envelope, thereby encouraging the lamp to run at a higher temperature.

Further, in accordance with another feature of the invention, a metallic reflector means is mounted on the outer surface of the light-transmissive envelope. The internal surface of the reflector means reflects the light generated by the filament and said means concomitantly conducts away the heat generated by the filament. The reflector means also can serve as a connection to a lamp support.

Another feature of the invention resides in forming the stiff supporting element with a hollow interior and in using at least two elongated helical filaments which are coextensive with each other and supported on the stiff element. A switching means is operative to permit the two filaments to be selectively interconnected in parallel or with a single one in circuit. An elongated slug is located within the stiff element and is capable of movement within said element along the axis of elongation of same. Holding means are positioned adjacent each end of the element, and each of said holding means is capable of either retaining the slug adjacent itself or releasing the slug in response to a force exerted thereon. The movable slug, switching means and holding means provide a system for alternatively and automatically causing the light emitted from the lamp to be either dim or bright.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is an axial sectional view of an incandescent tubular lamp of the invention;

FIG. 2 is a broken-away perspective view of an embodiment of a refractory stiff hollow element and associated coiled filament;

FIG. 3 is an enlarged sectional view taken substantially along the line 3—3 of FIG. 2;

FIG. 4 is a view analogous to FIG. 3 but showing a solid refractory stiff element;

FIG. 5 is a view analogous to FIG. 2 but showing a different embodiment of a refractory stiff element and associated coiled filament;

DETAILED DESCRIPTION OF THE PREFERRED EMBODIMENTS

Figure 6:
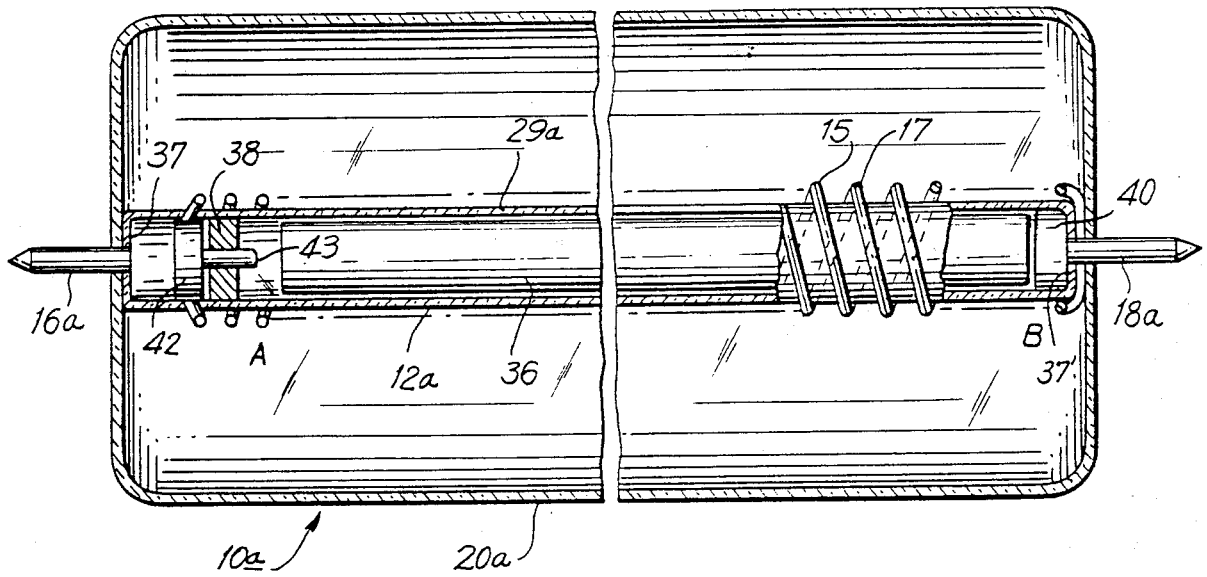
FIG. 6 is a sectional view of another embodiment of an incandescent tubular lamp of the invention.
Figure 7:
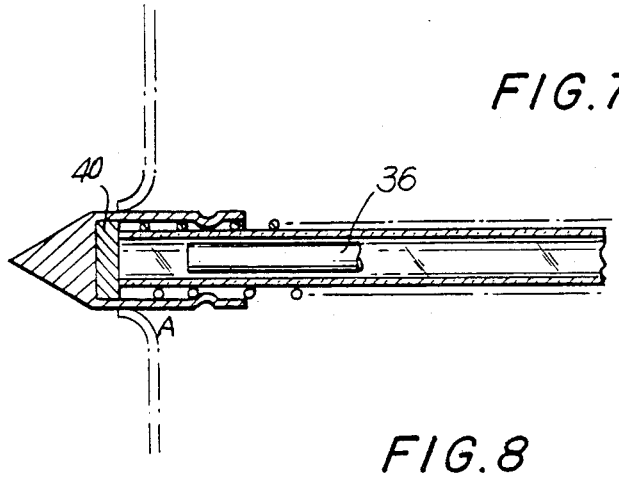
FIG. 7 is an enlarged sectional view taken substantially along the line 7—7 of FIG. 6.

Referring now in detail to the drawings, and more particularly to FIG. 1, the reference numeral 10 denotes one embodiment of an improved incandescent tubular lamp of the present invention.

The lamp 10 is characterized by the provision of an elongated refractory stiff filament-supporting element 12 which in this embodiment is hollow, a heavy helical filament 14 long enough to supply the necessary resistance for 120 volts, i.e. 120 ohms for a 120 watt bulb that when energized by a domestic source of electricity, e.g. 110 volts, becomes incandescent, two filament terminals 16, 18 and an elongated light-transmissive envelope 20. Because the filament is heavy and long in comparison to the fine wire like in a conventional incandescent 100 watt bulb, the efficiency of the new bulb in lumens per watt is about 30% better. The lamp may additionally include an external reflector 22 on the envelope 20.

The elongated refractory stiff element 12 is provided for the purpose of supporting the resistive filament coil 14. In the embodiment of the lamp as shown in FIGS. 2 and 3, the refractory stiff element 12 is triangularly shaped in cross-section and the resistive filament coil only touches the stiff element at three equispaced points 24, 26, 28 of each 360° convolution of the coil.

The stiff refractory element 12 may be constituted of any appropriate material that is not appreciably dimensionally altered or adversely affected by incandescent temperatures. In the embodiment of FIG. 4, element 12 is made of a ceramic material and is extruded in a solid triangular cross-sectional shape.

As shown in FIG. 2, a hollow triangularly shaped refractory stiff element 12 may be extruded around a reinforcing part 29 which in a preferred embodiment, is a flat steel wire of isosceles V-shape. The part 29 provides the reinforcing refractory element 12 with additional mechanical strength and rigidity to aid in supporting the filament coil 14. The reinforcing part 29 is not necessary, as the refractory element 12 will support the filament coil 14 alone, as shown in FIG. 4, and only supplies additional strength and rigidity.

If said refractory stiff element 12 is constituted of ceramic material on its external surface, it is preferred that such material be of a light, e.g. white, glazed color so that said refractory element will reflect a maximum amount of light from the glowing filament coil 14, and that the convolutions of the coil be spaced far enough apart to permit reflection.

The filament coil is capable of generating light when heated to incandescence in response to a flow of electrical current therethrough. As shown in the drawings, the filament coil 14 preferably is coiled about the element 12.

As shown in FIG. 5 in another embodiment of the invention, the support element 12 is a glass or quartz tube T having an exterior diameter barely smaller than the interior diameter of the coil. The tube has a hollow bore. Desirably, the interior surface of the tube, i.e. the bore, is reflectively plated, e.g. the bore is coated with reflective metal, for example, silver, so that light from the filament coil is reflected outwardly.

The filament coil 14 is heavier than resistive filaments heretofore used in incandescent lamps and, because of this, element 12 is included to support the filament coil. Because the filament coil 14 is heavier (grams per unit length) than prior art filaments, it can be burned at a higher temperature without breakage. Additionally, the filament coil 14 is longer than prior art filaments, permitting a single lamp to be the equivalent of ten 12-volt filaments connected in series.

Figure 10:
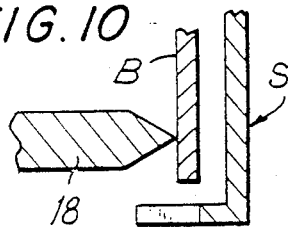
FIG. 10 is a sectional view through a lamp socket and illustrating the terminal point to flat socket blade contact which minimizes heat transfer from the lamp to the socket.

The terminals 16 and 18 are situated proximate and connected to the ends of filament coil 14, terminal 16 being located at filament end 30 and terminal 18 being located at filament end 32. Both terminal 16 and terminal 18 are capable of being physically and electrically connected to different electrical sockets S (FIG. 10). The two terminals preferably are outwardly tapered, i.e. of a point type, so that their tips are of minimal area. The tips of the terminals are mutually coaxial and coaxial with the longitudinal axis of the envelope. The tapered terminals permit a user to rotate the lamp 10 about the tips of the terminals and, more specifically, about the contact areas between the tips of the terminals and the flats of the socket blades B that are perpendicular to the lengths of the terminals. The tapered terminals act as heat traps so that the contacts of the socket absorb very little of the heat being directly conducted from the energized filament coil 14. The heat-trap nature of the terminals permits lamp 10 to provide more light for a given amount of energy than heretofore provided by prior art lamps. Additionally, the tapered configuration of terminals 16 and 18 eliminates the shock hazard associated with changing a conventional incandescent lamp in a conventional fixture.

In the embodiment of the lamp 10 illustrated in FIG. 1, the reflector 22 is mounted to or bonded on the outer surface of the cylindrical envelope 20. The reflector 22 reflects to a place of use the light generated by filament coil 14 that otherwise would be wasted, and also leads away the heat generated by said filament which, in turn, is transmitted to the envelope away from the latter. By conducting the aforementioned heat away from the envelope, reflector 22 prevents said envelope from reaching a temperature that would cause the envelope to discolor and, hence, block some of the light passing through it from the filament.

The reflector 22 may be constituted of any appropriate material and in a preferred embodiment is made of steel with a reflective surface at the envelope. The reflector 22 is curved in shape to match the curvature of the envelope, is thin, and is wrapped about and attached, as by bonding, to less than one-half of the circumference of the envelope 20. The reflector 22 is specular or painted white on the envelope facing surface thereof so as to augment its light-reflecting utility. It can be used to direct the light emanating from the lamp to whatever area a user desires. The reflector 22 can additionally serve as a means for mounting the lamp 10 on an appropriate surface or fixture, e.g. by forming mounting holes on the reflector flange.

Shown in FIG. 6 is another embodiment of the lamp 10*a*, wherein a stiff filament-supporting element 12*a* is formed with an interior bore 29*a*. The lamp 10*a* includes two (rather than a single) interleaved, i.e. interconvoluted, elongated helical resistive filaments 15 and 17, both of which are supported on element 12*a* with every convolution of each coil located midway between successive convolutions of the other coil. The lamp 10*a* has two terminals 16*a*, 18*a* and an elongated light-transmissive envelope 20*a*, both the terminals and the envelope being identical in structure and function to the terminals and light-transmissive envelope of the lamp 10. Slidable in the bore 29*a* of the element 12*a* is an elongated slug 36. The slug 36 is made of a magnetizable material and in a preferred embodiment is constituted of a non-permanently-magnetic soft iron which is a closed-end hollow light tube to reduce its mass.

Positioned adjacent the two opposite ends 37 and 37' of the bore 29*a* are two releasable holding means 38 and 40, which in a preferred embodiment are permanent magnets. The releasable holding means 38 and 40 are so constituted that each is capable of either retaining the slug 36 in adjacency or of releasing the slug 36 in response to a magnetic force exerted longitudinally upon the slug in a direction toward the opposed holding means. The slug is somewhat shorter, e.g. one-half inch, than the space between the facing surfaces of the two permanent magnets.

Figure 8:
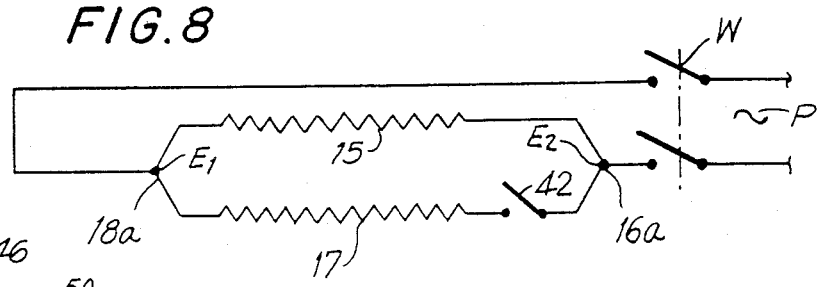
FIG. 8 is a schematic wiring diagram illustrating the circuitry of the incandescent lamp of FIG. 6.

As shown in FIG. 8, the two filaments 15 and 17 are permanently directly interconnected at one set of ends and are interconnected through a two-position momentary switch 42 at their other set of ends. The switch can be either normally open or normally closed, and here is shown as normally open. When the switch 42 is closed, the filaments are connected in parallel to a source of power P through a wall switch W; when the switch 42 is open, only one filament is connected to the wall switch W, the other filament being disconnected from the wall switch. The switch 42 is inside of the envelope 20*a*, indeed, inside of the hollow cylindrical tube 12*a*, and includes an actuating pin 43 which extends through and projects beyond the inner face of the magnet 38.

When the switch 42 is open as shown in FIG. 8, the filament 15 is connected to both electrodes $E_1$ and $E_2$, but the filament 17 is connected only to the electrode $E_1$. Hence, when current flows through the circuit, only the filament 15 will be energized. However, when the switch 42 is closed, both the filament 15 and the filament 17 are connected to the electrodes $E_1$ and $E_2$ and, hence, when current flows through the circuit, both filaments 15 and 17 will be energized. When only the filament 15 is energized, the light emitted will be dimmer than when both filaments 15 and 17 are energized. Preferably, the resistance value of the filament 15 is greater than that of the filament 17, so that the light emitted when both filaments are energized is more than double that emitted when only the filament 15 is energized.

As shown in FIG. 6, when the slug 36 is in position B with one end against the magnet 40 and the other end spaced from the magnet 38 so that the pin 43 is unactuated and the switch 42 is open, the two filaments are connected to each other at only one point, with only the filament 15 being connected to both electrodes. Hence, at this time, only the filament 15 is energized in response to the flow of electrical current through the circuit upon closure of the wall switch W. As heretofore stated, this state occurs when the switch 42 is in its open position. When the slug 36 is in position A, the two filaments are connected in parallel so that both filaments are energized when the switch 42 is in its closed position.

Slug 36 shifts longitudinally within the element 12*a* in response to a magnetic force which is created when either filament 15 or filaments 15 and 17 are energized by an initial flow of current therethrough. Theoretically, the slug has an idle central position in which the longitudinal center of the slug is located midway between the holding magnets 38 and 40 which are located at the ends of the hollow filament-supporting tube, with the ends of the slug equally spaced from the inner facing surfaces of the magnets. As a practical matter, this central internal position will seldom, if indeed ever, be realized in the field. Usually—almost invariably—one end of the slug will abut the inner facing surface of one or the other of the magnets.

To understand how the lamp 10*a* functions, let it be assumed that the end of the slug which is nearer to the magnet 40 contacts the inner surface of that magnet so that the opposite end of the slug is spaced from the inner surface of the magnet 38 and also is out of engagement with the tip of the pin 43. At this time, the momentary switch 42 will be in its normally open position, the contacts of said switch being biased apart by a spring (not shown) that is internal to the switch. Since the switch contacts are open, only the filament 15 will be connected in circuit. Let it also be assumed that with the slug in such position and the switch 42 in such condition, the wall switch W is open so that no electric energy is supplied to the lamp 10*a*.

Then, the wall switch W is closed, upon which current will start to flow through the filament 15. No current yet will flow through the filament 17 because the switch 42 is open. The filament 15 has a resistance characteristic common to all filaments, namely, its cold resistance is much lower than its incandescent resistance, so that the initial flow of current is high, i.e. current surges through the filament 15. Such sudden surge of current causes the filament to act as an electromagnetic coil with the concomitant creation of an inductive field. This field acting on the slug will set the slug in motion toward its central position. However, because the surge current is high and the inductive magnetic field therefore strong, this field acting axially on the slug will not only move the slug away from the magnet 40 toward the central position of the slug in the tube, but will, because of the inertial momentum built up in the slug, move the slug beyond its central position, and indeed move the slug, as it coasts, beyond central position, until its opposite end abuts the opposed magnet 38 where it will be held because the electrically induced magnetic field quickly dies out as the filament 15 reaches ihcandescence. The slug thus is locked magnetically in position A. As the slug abuts the magnet 38, it will engage the tip of the actuator pin 43 and thereupon close the contacts of the switch 42. Closing of these contacts connects the filaments 15 and 17 in parallel so that when the slug is locked in position A both filaments are energized and the lamp emits a maximum of light energy. Energization of the filament 17 comes so quickly upon the heels of the energization of the filament 15 that the slug is not subjected to an independent centralizing action and will remain locked in position A.

Now if the wall switch is opened, the slug will remain in engagement with the magnet 38, although both filaments at this point are deenergized. When the wall switch is closed again, following a period of deenergization of the lamp, initial energization of the two filaments 15 and 17 will tend to once more move the slug toward a central position, this time in the opposite direction to that experienced upon the first-described energization. The slug will, by virtue of the inductive field created, be urged toward a centralized position and will coast past that position until the slug engages the inner surface of the magnet 40 where it will be locked. This reverse action opens the circuit to the filament 17 whereupon only the filament 15 will remain energized. Hence, the lamp will be shifted from a dim lighting condition (when the filament 15 solely is energized) to a bright lighting condition when both filaments are energized, and this change-over from dim to bright or from bright to dim every time the wall switch is closed and opened will occur without the need for any external electronics or mechanical switching. The changeover is simply a function of sequential operation of the wall switch or an equivalent switch.

It will be appreciated that although the description that just has been set forth utilizes a normally open switch 42, the switch 42 will function in a similar manner if it is normally closed.

The efficiency of the lamp 10*a* can be increased by internally coating the support 12, if of transparent material, with a specular coating which will act as a mirror to reflect the maximum amount of light emitted by the incandescent filaments 15 and 17. The spacing between the interleaved coils encourages such reflection.

Figure 9:
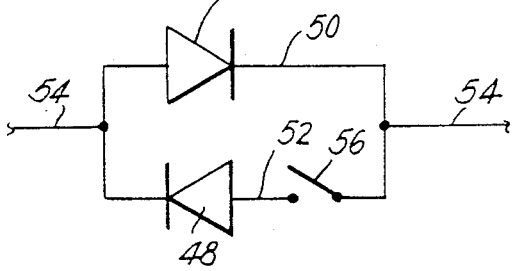
FIG. 9 is a schematic wiring diagram of a segment of a circuit to be employed in conjunction with the circuit of FIG. 8 to obtain a different arrangement for securing different degrees of illumination upon successive energizations of the lamp.

Any alternate electric circuitry and parts can be used to create the effect of alternating the actuated condition of the lamp from bright to dim and back, one such arrangement being illustrated in FIG. 9. In this figure, a pair of diodes 46, 48 are located in parallel branches 50, 52 between the filaments 15, 17 and a power line 54. One of the branches has a momentary switch 56 interposed therein. When the wall switch W is closed and the internal switch 56 is open, current will flow only through one of the diodes properly oriented to pass current, and will only flow in alternate half-cycles so that the light will run at a dim rating. When the internal switch 56 is closed, full wave power will be supplied to the lamp. The switch 56 is located in the tube in the same position as the switch 42 and is operated by the slug 36 upon alternate energization of the lamp.

The various embodiments of the lamp of this invention provide an improved low-cost, low-energy-consuming incandescent lamp which has increased light efficiency without an increase in power consumption. All embodiments of the lamp are relatively inexpensive to produce; all embodiments emit light that is pleasing and relaxing to the eye. The various embodiments of the lamp can be easily adapted for use with a conventional incandescent screw shell light socket. Additionally, the various lamps are of a construction that is easily adapted to continuous automatic assembly.

It will be understood that each of the elements described above, or two or more together, may also find a useful application in other types of constructions differing from the types described above.

While the invention has been illustrated and described as embodied in an improved incandescent lamp which, while providing increased light efficiency, remains low-cost and is low-energy-consuming, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should be and are intended to be comprehended within the meaning and range of equivalence of the following claims.

Having described the invention, there is claimed as new and desired to be secured by Letters Patent:

1. An improved incandescent lamp comprising:

(A) an elongated light-transmissive envelope having ends, (B) an elongated refractory stiff hollow element disposed within the envelope substantially coaxially thereof, (C) at least one elongated helical resistive filament wound about and internally supported over substantially the full length of the filament by the stiff hollow element over substantially the full length of said stiff hollow element, said filament generating light when heated to incandescence by flow of electric current therethrough, (D) means supporting the ends of the stiff hollow element at the ends of the envelope, (E) two electrically conductive terminals, one of said terminals being situate proximate and connected to one end of the resistive filament, and the other terminal being situate proximate and connected to the other end of the resistive filament, (F) means mounting each terminal to a different end of the envelope coaxially of the envelope.

2. An incandescent lamp as set forth in claim 1, wherein the convolutions of the resistive filament are spaced apart from one another, and wherein the stiff hollow element includes a reflecting surface.

3. An incandescent lamp as set forth in claim 2, wherein the means for reflecting light is on an external surface of the stiff hollow element.

4. An incandescent lamp as set forth in claim 2, wherein the stiff hollow element is light-transmissive the reflecting means is on the internal surface of the stiff hollow element.

5. An incandescent lamp as set forth in claim 1, wherein the stiff hollow element is constituted of a light-colored ceramic material, said material reflecting light from the resistive filament when it is incandescent.

6. An incandescent lamp as set forth in claim 1, wherein the stiff hollow element constitutes a material which has an internal metal element to provide reinforcement therefor.

7. An incandescent lamp as set forth in claim 1, wherein the stiff hollow element is a white glazed ceramic material extruded around a steel rod.

8. An incandescent lamp as set forth in claim 1, wherein the terminals are mutually coaxial and coaxial with the longitudinal axis of the envelope and have outwardly tapered external ends adapted to engage flat socket contacts perpendicular to the lengths of the terminals whereby to reduce the conductive flow of heat away from the lamp to the sockets.

9. An incandescent lamp as set forth in claim 1, which further includes a metal reflector secured to the exterior surface of the envelope.

10. An incandescent lamp as set forth in claim 9, wherein the reflector is bonded to the envelope.

11. An incandescent lamp as set forth in claim 9, wherein the reflector includes means for attachment to a support.

12. An incandescent lamp as set forth in claim 10 or 11, wherein the reflector is wrapped about less than half of the circumference of the envelope.

13. An incandescent lamp as set forth in claim 1, wherein the resistive filament includes two interleaved resistive coils, the convolutions of each coil being spaced from the adjacent pair of convolutions of the other coil.

14. An incandescent lamp as set forth in claim 13, wherein a magnetic slug is axially slidable within the stiff element, and wherein means is included adjacent each end of the stiff element to magnetically attract the slug when the slug is near the same.

15. An incandescent lamp as set forth in claim 14, wherein a switch is located adjacent an end of the stiff element, said switch having an actuator located in the path of travel of the slug as the slug approaches an end of the stiff element, said switch having contacts which, when closed or opened by engagement of the slug with the actuator, either place the two resistive coils in parallel in the energizing circuit for the resistive filament, or connect only one of the resistive coils in the energizing circuit, whereby successive energizations of the lamp will cause either one or both resistive coils to be energized.

16. An incandescent lamp as set forth in claim 15, wherein the switch is a momentary normally-open switch.

17. An incandescent lamp as set forth in claim 1, wherein means is included internally of the lamp automatically to change the state of incandescence of the filament each time the filament is energized.

18. An incandescent lamp as set forth in claim 17, wherein the means for changing the state of incandescence of the filament each time the filament is energized includes a pair of oppositely oriented rectifiers connected in parallel and a switch in series with only one of the rectifiers, and means to oppositely actuate the switch each time that the filament is energized.

19. An incandescent lamp as set forth in claim 1, wherein the filament is heavy.

* * * * *